US005934493A

United States Patent [19]

Han

[11] Patent Number: 5,934,493

[45] Date of Patent: Aug. 10, 1999

[54] LID FOR BEVERAGE CONTAINER

[76] Inventor: Ki Su Han, 2249 Lerona Ave., Rowland Heights, Calif. 91748

[21] Appl. No.: 09/001,153

[22] Filed: Dec. 30, 1997

[51] Int. Cl.[6] ..... B65D 55/02

[52] U.S. Cl. ..... 215/227; 206/222; 206/568; 426/115

[58] Field of Search ..... 206/217, 219, 206/222, 568; 426/120, 112, 115, 130; 215/227

[56] References Cited

U.S. PATENT DOCUMENTS

| | | | |
|---|---|---|---|
| 3,779,372 | 12/1973 | De Lloret | 206/47 A |
| 3,796,813 | 3/1974 | Kurland | 99/78 |
| 4,387,809 | 6/1983 | Botzler | 206/526 |
| 4,631,715 | 12/1986 | Hoover | 369/68 |
| 4,785,931 | 11/1988 | Weir et al. | 206/222 |
| 5,035,320 | 7/1991 | Plone | 206/219 |
| 5,052,553 | 10/1991 | De Sanctis | 206/219 |
| 5,125,534 | 6/1992 | Rose et al. | 222/54 |
| 5,431,276 | 7/1995 | Lialin | 206/222 |
| 5,529,179 | 6/1996 | Hanson | 206/219 |
| 5,711,420 | 1/1998 | Spring | 206/222 |

*Primary Examiner*—S. Thomas Hughes
*Assistant Examiner*—Trinh Nguyen

[57] ABSTRACT

A disposable lid has a flexible disk-like body and at least one slot opening formed in the body. The slot opening is adapted to receive a small container containing additives, such as sugar and cream. The slot opening is defined by a plurality of intersecting lines which break open upon application of predetermined pressure. The lid also has at least one protrusion formed near the slot opening to create an opening in the container as the container is inserted into the slot opening. The small additive container described above preferably has an elongated body which is adapted to be inserted into the slot opening of the lid through the intersecting lines. The elongated body is inserted into the slot opening, a release opening is formed in the elongated body of the additive container to release the content. The elongated body of the additive container used for the above lid has a break line which breaks open to release a content contained in the elongated body when a sharp object or a protrusion is pressed against the break line. The protrusion of the lid and the break line of the additive container are aligned so that when the additive container is inserted into the slot opening, the protrusion causes the break line to break open.

14 Claims, 5 Drawing Sheets

LID FOR BEVERAGE CONTAINER

BACKGROUND OF THE INVENTION

1. Field of the Invention

This invention relates to a disposable lid for beverage container, and more particularly, to a disposable lid having a plurality of tearable slits for receiving specially designed packaged sugar or cream by inserting the packages through the slits.

2. Description of Related Art

Beverage container lids are well-known to prevent the spillage of the contents of the container. Plastic disposable lids having openings for inserting plastic straw are commonly found in fast food restaurants. Similarly, disposable lids for hot beverage, such as coffee and tea, are also commonly used.

Conventional disposable lids have removable flaps and/or straw openings to access the content. When drinking hot beverage, the flaps are either removed or folded backwards to create a drinking hole. However, in many conventional lids, the opening is not sufficiently large to pour in sugar and cream. In stead, the entire lid must be first removed to add desired amount of sugar and cream into the content. The use of such conventional lids may not be problematic when a consumer is not driving.

However, many drivers purchase their food and drinks through drive-in windows of restaurants and eat and drink while driving. Driving while eating and drinking already creates danger to the driver as well as others driving near by. To compound the problem, many drivers try to add sugar and cream to their drinks while driving. The design of conventional plastic lid provides no other alternative but to completely remove the plastic lid from a container containing hot beverage and adding cream and sugar therein. Such construction of plastic lids is cumbersome and sometimes creates dangerous driving condition.

Another problem with convention disposable lids is that once sugar and cream are added to the container, the packages for sugar and cream must be separately discarded creating more trash.

SUMMARY OF THE DISCLOSURE

It is an objective of the present invention to provide a disposable lid which overcomes the aforementioned shortcomings and disadvantages associated with conventional designs. Specifically, the present invention allows the addition of cream and sugar or other edible substance into the container without physically opening the lid.

It is another objective of the present invention to provide a disposable lid which retains sugar and cream package containers therein so that the entire container may be discarded after the content has been consumed.

According to an embodiment of the present invention, a disposable lid has a flexible disk-like body and at least one slot opening formed in the body. The slot opening is adapted to receive a small container containing additives, such as sugar or cream. The slot opening is defined by a plurality of intersecting lines which break open upon application of predetermined pressure. The lid also has at least one protrusion formed near the slot opening to create an opening in the container as the container is inserted into the slot opening. Preferably, the lid has four slot openings.

The small additive container described above preferably has an elongated body which is adapted to be inserted into the slot opening of the lid through the intersecting lines. The elongated body is inserted into the slot opening, a release opening is formed in the elongated body of the additive container to release the content.

As a further aspect of the embodiment of the present invention, the elongated body of the additive container has a break line which breaks open to release a content contained in the elongated body when a sharp object or a protrusion is pressed against the break line. Preferably, the protrusion of the lid and the break line of the additive container are aligned so that when the additive container is inserted into the slot opening, the protrusion causes the break line to break or tear open.

Depending on the type of substances contained in the container, it is sometimes preferable that the elongated body of the additive container is made with a liquid permeable material while preventing non-liquid content from flowing through the elongated body. Such liquid permeable wall is useful when water soluble additives, such as sugar, is stored in the container.

The elongated body generally has a covered opening which breaks open when pressed against a protrusion to release a content contained in the elongated body when a force is applied on the covered opening. Moreover, the elongated body has a substantially square cross section, each side of the elongated body having at least one covered opening.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
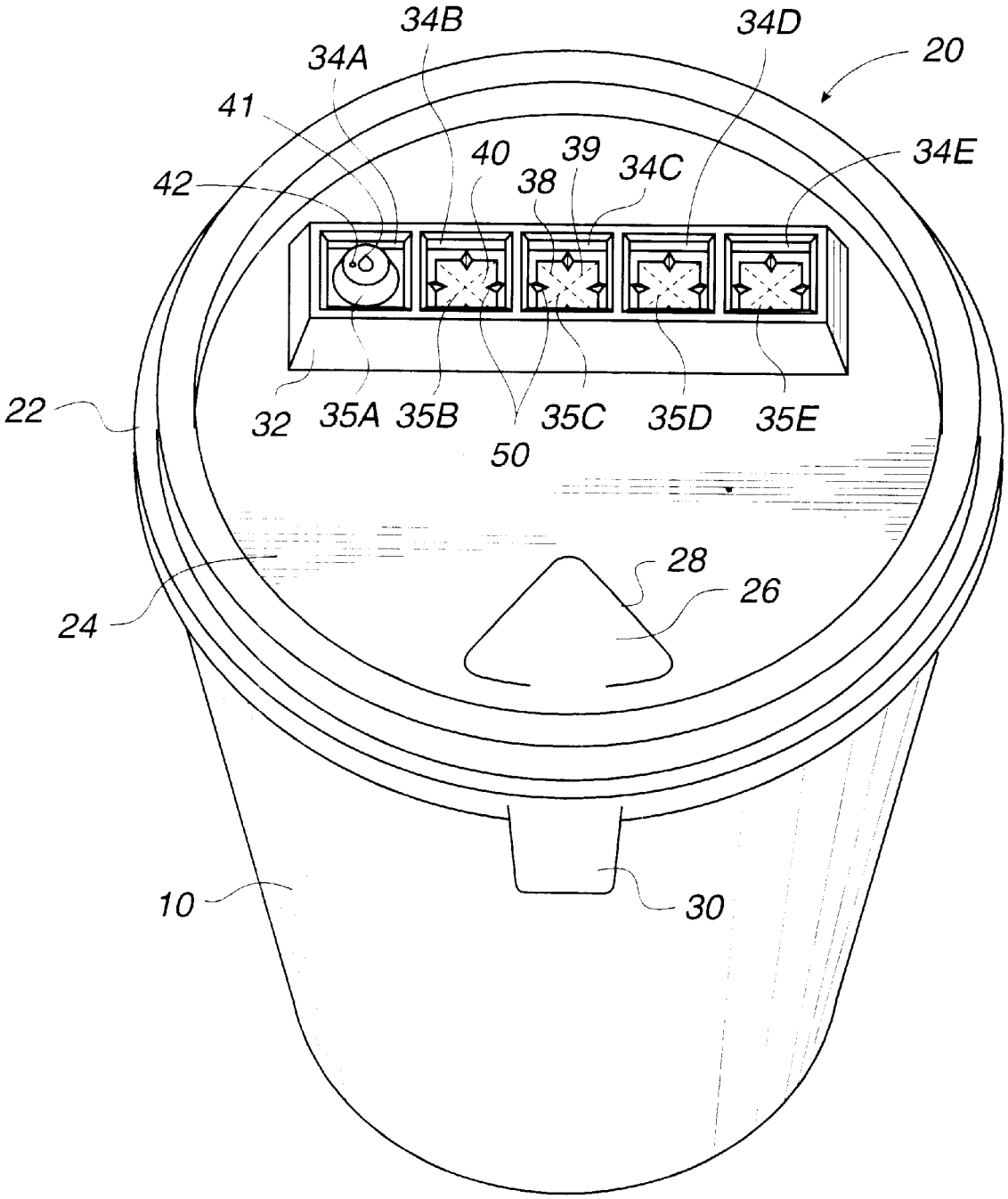
FIG. 1 illustrates a perspective view of a first embodiment of the disposable lid.

FIG. 1 illustrates a perspective view of a disposable lid 20 for a beverage container 10 according to the present invention. The disposable lid 20 is preferably made with plastic and is designed to be used with a conventional disposable beverage container 10. The lid 20 includes a rim 22 constructed to engage an opening of the beverage container 10 to hold the lid 20 firmly on the container 10. The rim 22 surrounds a disk-like body 24 which covers the container opening when the lid 20 is placed on the container 10.

The body 24 has a drinking opening 26 which is defined by a shallow trough 28 thermoformed during manufacturing. When a tab 30 attached to the lid 20 is pulled toward an upward direction, the lid 20 is tore open in a shape defined by the trough 28 thus forming the drinking opening 26.

The body 24 also preferably has a raised platform 32 defining five receptacles 34A–34E. Each receptacle has the same shape and size as the others. The receptacles 34B–34E include slot openings 35B–35E. The slot opening 35B has two mutually perpendicular slits 38 and 39. The slits 38 and 39 cross at their midpoints at right angles, thus being mutually bisecting. The slits 38 and 39 are sized according to the size of additive containers 100 and 200 shown in FIGS. 4 and 5, and may be preferably each be about ½"–¾" in overall length. These slits 38 and 39 are situated so as to form a pattern of four adjacent wedge-shaped sections 40 which are typically displaced inwardly during the insertion of either one of the additive containers 100 or 200 into the slot opening 35B.

The slits 38 and 39 may be formed by perforation or narrow troughs, such as the ones used for forming the drinking opening 26, during thermo-formation of the lid 20. The narrow troughs are typically displaced inwardly when an additive container 100 or 200 is inserted.

Surrounding a square aperture created by four wedge-shaped sections 40, there are preferably four protrusions 50. Each protrusion 50 is placed at each side of the square aperture. As described in detail below, the protrusions 50 are used to make incisions into the containers 100 and 200 shown in FIGS. 4 and 5.

The above description in connection with the slot opening 35B and protrusions 50 also apply to the other slot openings 35C–35E, and thus will not be repeated here for brevity.

The receptacle 34A has a projection 35A with a sharp point 41 and a vent hole 42. In the preferred embodiment, the projection 35A has a generally trapezoidal-shaped cross section with a base, a top and inclined sides. The top of the projection 35A includes a vent hole 42 for releasing steam in the container 10 and a sharp point 41. The sharp point 41 is used for puncturing a hole into a cover membrane of the additive container 100 or 200. The details of the use of the sharp point 41 are described below.

Figure 2A:
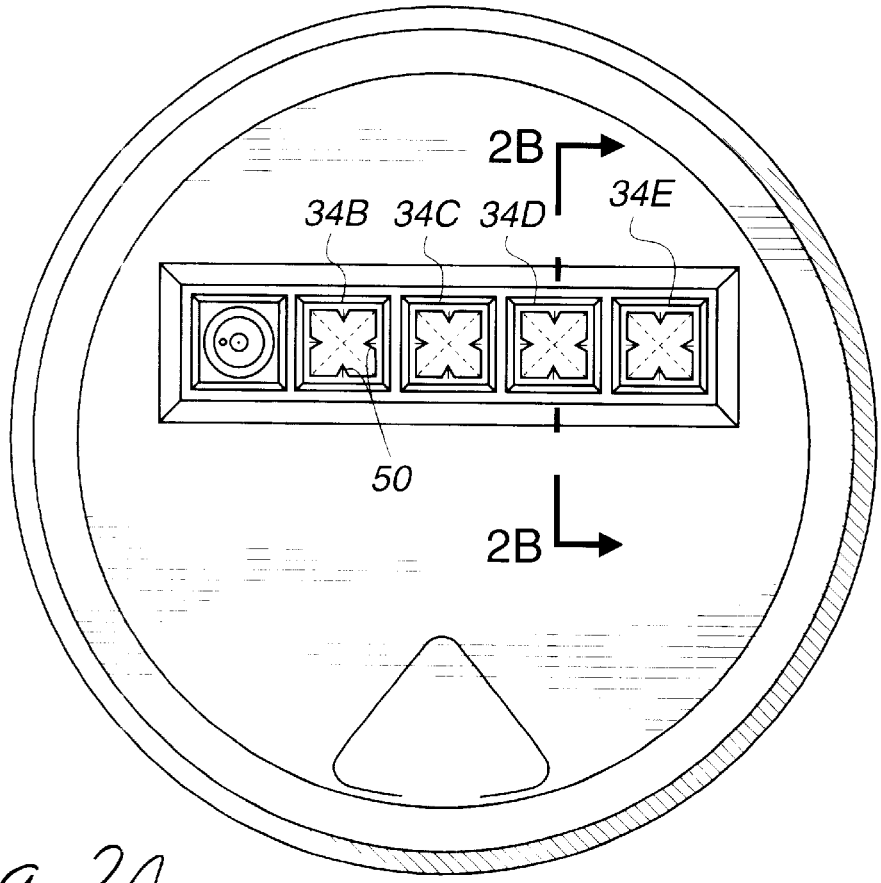
FIG. 2A illustrates a top plan view of FIG. 1.

FIG. 2A of the present invention illustrates a top plan view of the first embodiment. The four protrusions 50 in each one of the receptacles 34B–34E are clearly shown. Preferably, the four protrusions 50 are spatially positioned approximately at every 90 degrees.

Figure 2B:
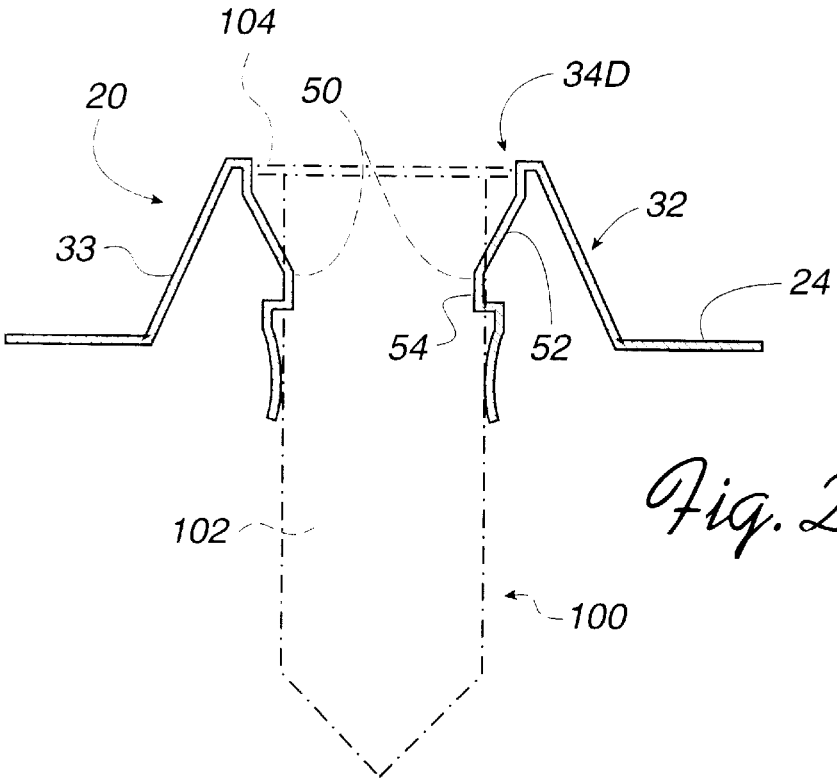
FIG. 2B illustrates a cross-sectional view in direction 2B shown in FIG. 2A.

FIG. 2B illustrates a cross-sectional view of the present invention in direction 2B as shown in FIG. 2A. In particular, the raised platform 32 is shown with respect to the body 24 of the lid 20. The raised platform 32 has a slanted side wall 33 to withstand a stronger vertical pressure. The receptacle 34D shown in FIG. 2B is shaped to receive a container 100. The top width of the receptacle 34D is preferably wider than the bottom width so that the elongated body 102 of the container 100 can snugly fit through the opening created in the receptacle 34D. The flange 104 of the container 100 is larger than the elongated body 102, and thus, the flange 104 snugly fits within the top portion of the receptacle but is blocked by the protrusion 50.

The protrusion 50 includes a downwardly angled wall 52 and a vertical cutting edge 54, preferably sharp, which cuts into thinner walls of the container 100. Preferably, the distance between the two opposite facing protrusions 50 is smaller than the width of the container 10 so that incisions can be made on opposite sides of the container 100. As an alternative embodiment, the protrusion 50 may be made of any shape and form, so long as it can cut or break through the walls of the container 100. For example, instead of having a downwardly angled wall 52, the protrusion 50 may have an upwardly angled wall 52 and a vertical cutting edge 54.

Figure 3:
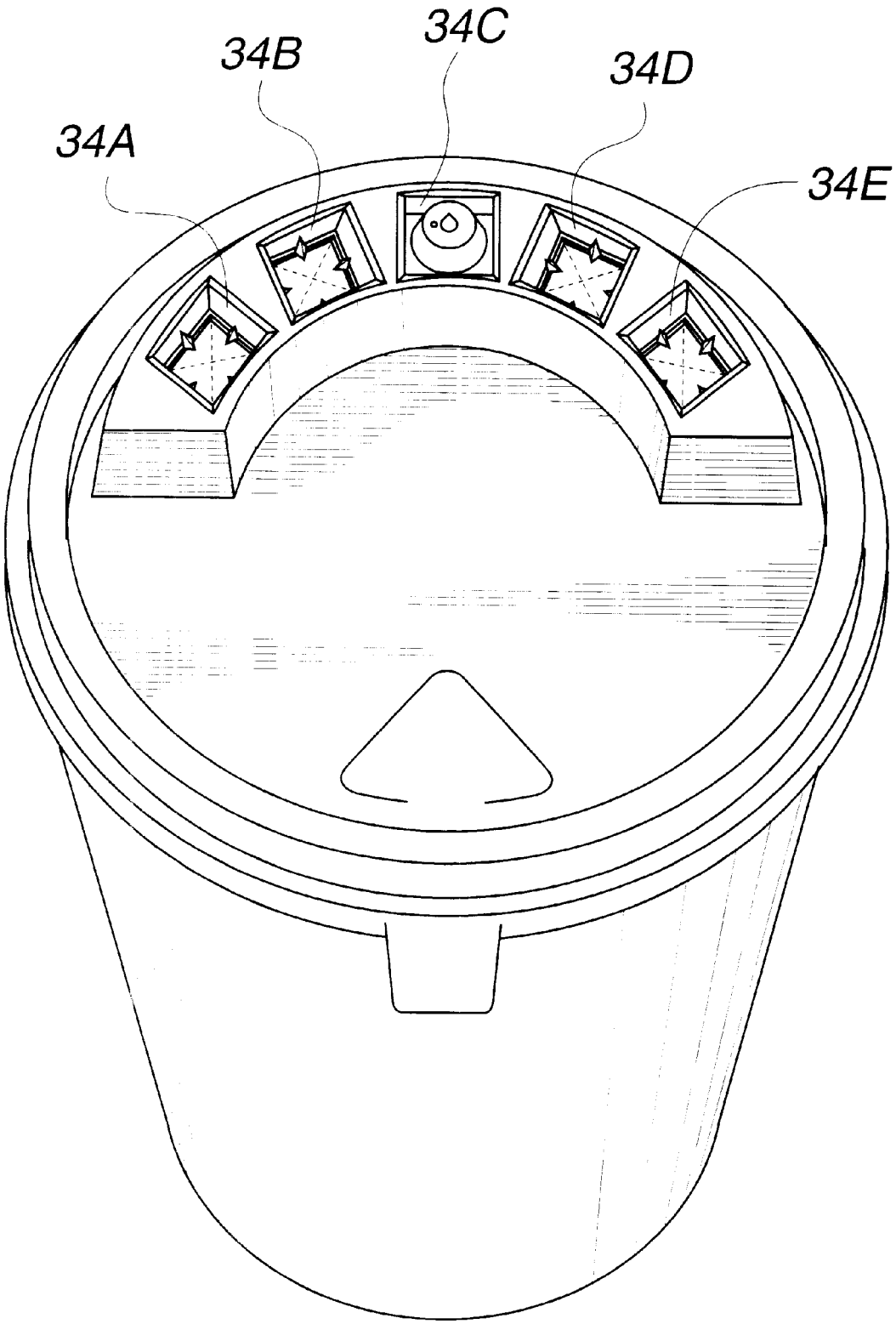
FIG. 3 illustrates a perspective view of a second embodiment of the present invention.

FIG. 3 illustrates a perspective view of a second embodiment of the present invention. The second embodiment is very similar to the first embodiment, except that the layout of the receptacles 34A–34E are in a semi-circular shape.

Figure 4:
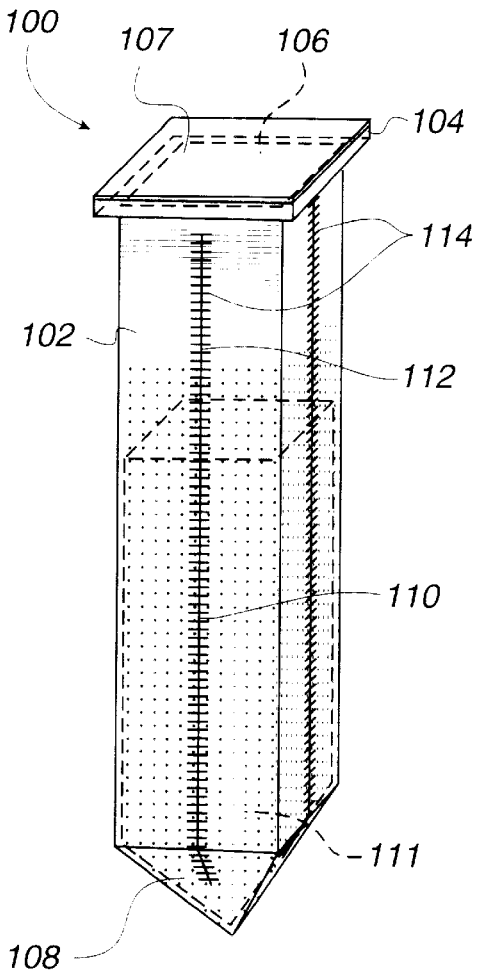
FIG. 4 illustrates a perspective view of a sugar container according to the present invention.
Figure 5:
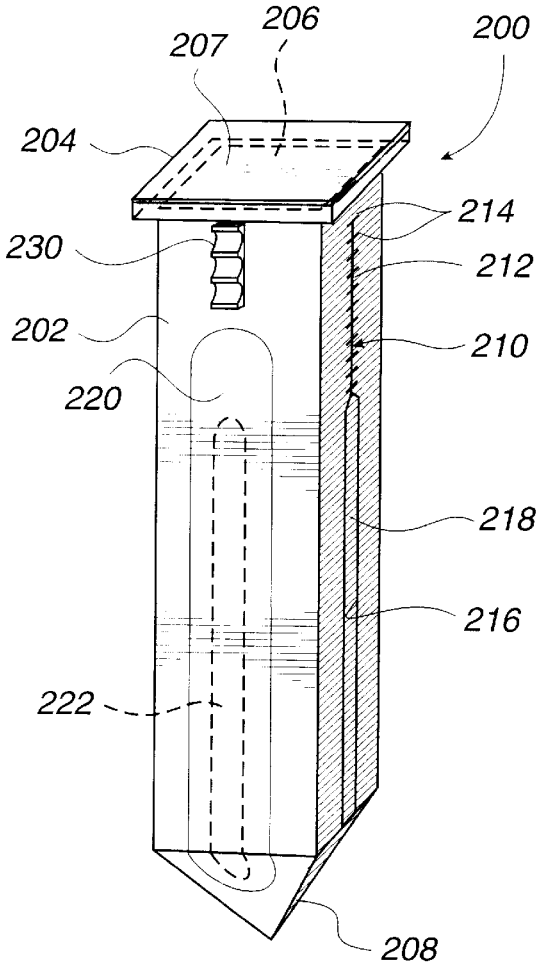
FIG. 5 illustrates a perspective view of a cream container according to the present invention.

FIGS. 4 and 5 illustrate perspective views of additive containers 100 and 200, respectively, according to the present invention. In particular, the additive container 100 of FIG. 4 is preferably used for storing sugar or other granulated substance. In order to differentiate the description of the two additive containers 100 and 200 to describe the present invention, the additive container 100 (FIG. 4) will now be described as sugar container 100 and the additive container 200 (FIG. 5) will now be described as cream container 200.

The sugar container 100 preferably has an elongated body 102, with a substantially square cross-section, and a generally flat flange 104 around the top of the elongated body 102 defining a top opening 106. The elongated body 102 has an inverse pyramid shaped lower end 108. The elongated body 102 has a hollow interior for receiving either powdered or granulated substance, such as sugar 111. The elongated body 102 may also have small holes which are sufficiently large enough to allow the flow of liquid, but sufficiently small enough to prevent the out flow of the non-liquid content in the sugar container 100. The elongated body 102 may preferably be about 1¼" to 2" long.

Also illustrated in FIG. 4 is a break line 110 formed in each side and along the length of the elongated body 102. The break line 110 is preferably formed by forming a trough along the longitudinal surface of the elongated body 102. For example, the break line 110 may have a long vertical trough 112 with many small horizontal troughs 114 crossing the vertical trough 112.

The top opening 106 of the elongated body 102 is covered with a thin membrane like cover 107 made of plastic, vinyl or other suitable material, which can be easily punctured with a sharp object. The cover 107 may also be peeled off of the flange 104 to expose the top opening 106.

The cream container 200, illustrated in FIG. 5 and which is similarly designed as the sugar container 100, preferably has an elongated body 202, with a substantially square cross-section, and a generally flat flange 204 around the top of the elongated body 202 defining an opening 206. The elongated body 202 has an inverse pyramid shaped lower end 208. The elongated body 202 has an hollow interior for receiving liquid additives, such as cream, syrup, etc.

On one side of the elongated body 202 of the cream container 200, there is a break line 210 along approximately ⅓ of the length of the elongated body 102. The break line 210 is preferably formed by forming a trough along the surface of the elongated body 202. For example, the break line 210 may have a vertical trough 212 with many small horizontal troughs 214 crossing the vertical trough 212. Immediately below the break line 210, there is a tearable slit 216 defined by a surrounding trough. When the slit 216 is depressed with a generally sharp object or a protrusion 50 (shown in FIG. 2B), the inner piece 218 of the body 202 is ripped away thus releasing the liquid content of the cream container 200 through the slit 216. Because there is no trough at the bottom of the slit, the inner piece 218 is not completely detached from the body 212, but instead, is still attached to the body 212. It is preferably that the break line 210 and the slit 216 combination is formed in the opposing surface of the cream container 200.

On another side of the elongated body 200 of the cream container 200, there is a vertical opening 222 covered with a cover 220. The vertical opening 222 is formed along the length of the body 202 and is partially extended through the pyramid shaped lower end 208. The vertical opening 222, when exposed, allows the content of the cream container 200 to be released into the beverage container 10. The cover 220 covering the vertical opening 222 is made of a thin, easily ripped, non elastic material, such as plastic, vinyl or coated paper. When a sharp protrusion 50 (shown in FIG. 2B) or object depresses the vertical opening 222 through the cover 220, the cover is cut or ripped open, hence, exposing the vertical opening 222. The cover 220 is sufficiently larger to cover the entire vertical opening 222.

Immediately above the vertical opening 222, there may be a plurality of ribs 230 for engaging the body 24, particularly the protrusions 50, of the lid 20. The plurality of ribs 230 has a generally rippled shape so there are peaks and valleys for engaging the lid 20.

It is preferably that the combined structure of the vertical opening 222 and the plurality of ribs 230 is also formed in the opposite surface of the cream container 200. The cream container 200 may have on all sides of its elongated body 202, vertical openings 222 in lieu of vertical slits 216. Alternatively, the cream container 200 may have all vertical slits 216.

The top opening 206 of the elongated body 202 is sealed with a peelable thin membrane like cover 207 made of plastic, vinyl, coated paper or other suitable material, which can be easily punctured with a sharp object. The cover 207 may be peeled off of the flange 204 to expose the top opening 206. Both the sugar container 100 shown in FIG. 4 and the cream container 200 shown in FIG. 5 may be made of thermo-formable materials, such as plastic, by an injection mold or other suitable manufacturing process.

Figure 6:
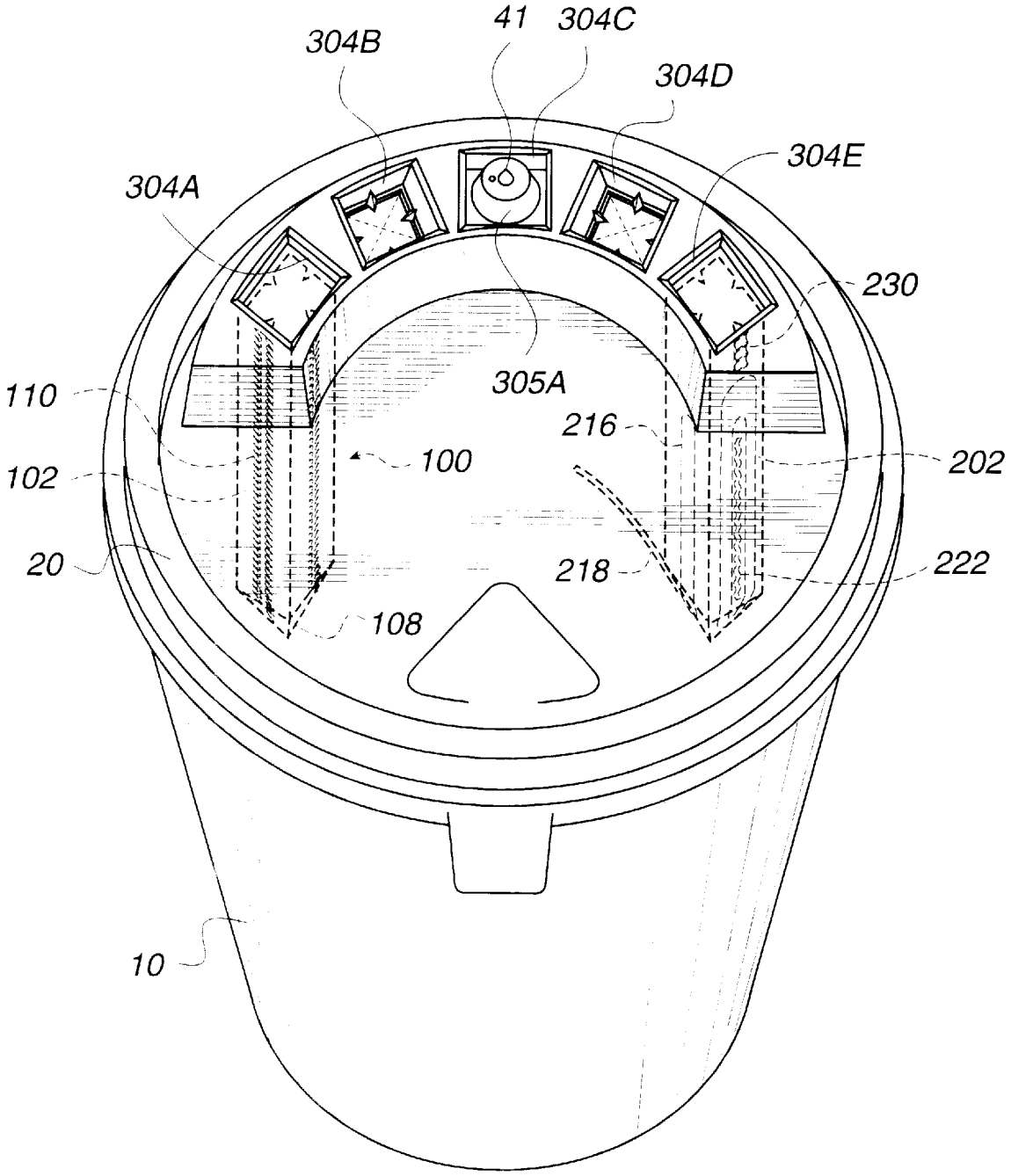
FIG. 6 illustrates a perspective view of the disposable lid being used with sugar and cream containers.

The operation of the present invention is described in reference to FIG. 6. Once the lid 20 is placed on a beverage container 10. The lid 20 will be secured over the opening of the container 10. A consumer who desires to use one package of sugar and one package of cream can simple pickup containers each containing such additives and insert each container into any available receptacles 304A–304E. For example, a sugar container 100 is inserted into the receptacle 304A. The elongated body 102 of the sugar container 100 has a pointed lower end 108 which facilitates the insertion process. In particular, as the lower end 108 depresses the slits 38 and 39 (shown in FIG .1), the four wedge-shaped sections 40 (shown in FIG. 1) are displaced inwardly thus allowing the sugar container 100 to slid into the lid 10. Because the receptacle 304A is slightly larger than the cross section of the elongated body 102 of the sugar container 100, the sugar container 100 is easily inserted.

When the sugar container 100 is being inserted, the four sharp protrusions 50 (see FIG. 1) surrounding the slot opening 35B break through the vertical break line 110 creating an opening for liquid to flow into and the sugar to flow out of the sugar container 100. Alternatively, even if for some reason the sharp protrusions 50 fail to break open the break line 110, the liquid in the beverage container 10 can still flow in and out of the sugar container 100 due to its liquid permeable wall construction of the elongated body 102, as described above.

The cream container 200 of the present invention is inserted the same way as the sugar container 100. The elongated body 202 of the cream container 200 has a pointed lower end which facilitates the insertion process. In particular, as the cream container 200 is inserted into, for example, the receptacle 304E, the four sharp protrusions 50 (see FIG. 1) surrounding the slot opening 35B rips through the vertical opening 222 or the slit 216, thus releasing the cream into the beverage container 10. When the cream container 200 is pressed into the lid 10, the plurality of ribs 230 engages the lid 10 thus, preventing the cream container 200 from being unintentionally separated from the lid 20.

Some people like to add more cream and sugar than the others. A person who desires to use more than four containers of the combination of sugar and cream can take advantage of the projection 305A having a sharp point 41. Before inserting a cream container 200 into one of the receptacles 304A–304E, the cream container 200 is held upside down. The top cover 207 covering the top opening 206 (see FIG. 5) is pressed against the sharp point 41 until a small vent hole is punctured in the top cover 207 of the cream container 200. Thereafter, the cream container 200 is partially inserted into a receptacle. Because of the vent hole created by the above process, the cream inside the cream container 200 is easily released into the beverage container 20. Since the cream container 200 is not fully inserted into the lid 10, the spent container is removed and another cream container is inserted into the receptacle using the same procedure as described above. This way, a person can use any much cream or other liquid additives as possible in his or her drink.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A lid and additive container for use with a beverage container, comprising:

a lid for placing on an opening of the beverage container, the lid including:

a flexible disk-like body;

at least one slot opening formed in the body, the at least one slot opening defined by a plurality of intersecting lines which break open upon application of predetermined pressure; and an additive container adapted to be used for and inserted into the at least one slot opening, the additive container including:

an elongated body for retaining an additive, e elongated body adapted to be inserted into the at least one slot opening of the lid through the intersecting lines, wherein as the elongated body is inserted into the at least one slot opening, a release opening is formed in the elongated body of the additive container to release the content.

2. A lid and additive container of claim 1, the lid further comprising at least one protrusion formed near the at least one slot opening to create the release opening in the elongated body of the additive container.

3. A lid and additive container of claim 1, the lid having a projection for puncturing a vent hole into the additive container.

4. A lid and additive container of claim 1, wherein said at least one slot openings comprises four slot openings.

5. A lid and additive container of claim 2, wherein the elongated body has a break line which breaks open to release a content contained in the elongated body when pressure is applied on the break line.

6. A lid and additive container of claim 5, wherein the elongated body has a substantially square cross section, each side of the elongated body having at least one break line.

7. A lid and additive container of claim 6, wherein the protrusion of the lid and the break line of the additive container are aligned so that when the additive container is inserted into the slot opening, the protrusion causes the break line to break open.

8. A lid and additive container of claim 7, wherein the elongated body of the additive container is made with liquid permeable material which prevents non-liquid content from flowing through the elongated body.

9. A lid and additive container of claim 2, wherein the elongated body defines a covered opening which breaks open to release a content contained in the elongated body when the covered opening is punctured.

10. A lid and additive container of claim 9, wherein the elongated body has a substantially square cross section, each side of the elongated body having at least one covered opening.

11. A lid and additive container of claim 6, wherein the protrusion of the lid and the covered opening of the additive container is aligned so that when the additive container is inserted into the at least one slot opening, the protrusion causes the break line to break open.

12. A lid and additive container of claim 2, wherein the elongated body of the additive container has a plurality of ribs for releasably engaging the lid.

13. A lid for fitting a beverage container and for use with a dispenser containing a substance to be dispensed in the beverage container, the lid comprising:

a flexible disk-like body;

at least one well formed in the body, the at least one well having a breakable bottom and being configured to receive the dispenser; and at least one protrusion erected on an inner side of the well, wherein when the dispenser is inserted in the at least one well, the dispenser breaks open the bottom of the at least one well and the at least one protrusion of the at least one well makes an incision in the dispenser to dispense the substance in the beverage container.

14. A lid of claim 13, the lid having a projection for puncturing a vent hole in the dispenser.

* * * * *